US005359187A

United States Patent [19]

Weiss

[11] Patent Number: 5,359,187

[45] Date of Patent: Oct. 25, 1994

[54] MICROCHANNEL PLATE WITH COATED OUTPUT ELECTRODE TO REDUCE SPURIOUS DISCHARGES

[75] Inventor: Robert E. Weiss, San Francisco County, Calif.

[73] Assignee: Intevac, Inc., Santa Clara, Calif.

[21] Appl. No.: 33,514

[22] Filed: Mar. 18, 1993

[51] Int. Cl.[5] ..... H01V 31/50

[52] U.S. Cl. ..... 250/214 VT; 313/105 CM

[58] Field of Search ..... 250/214 VT; 313/103 CM, 313/105 CM

[56] References Cited

U.S. PATENT DOCUMENTS

| | | | |
|---|---|---|---|
| 3,260,876 | 7/1966 | Manley et al. | 250/214 VT |
| 3,634,712 | 1/1972 | Orthurber | 313/105 CM |
| 4,095,136 | 6/1978 | Niklas | 250/214 VT |

*Primary Examiner*—David C. Nelms

*Attorney, Agent, or Firm*—Stanley Z. Cole

[57] ABSTRACT

A microchannel plate (MCP) apparatus and method in which the output metalization layer or electrode is covered with a thin coating to reduce the number of spurious electron emissions striking the phosphor screen or other collection anode in an image intensifier. Microchannel plates manufactured in this way have the beneficial effect of improving yield in the manufacture of night vision devices.

13 Claims, 2 Drawing Sheets

MICROCHANNEL PLATE WITH COATED OUTPUT ELECTRODE TO REDUCE SPURIOUS DISCHARGES

TECHNICAL FIELD

This invention relates to an improvement in microchannel plates (MCPs) and to structures using MCPs. Microchannel plates are typically used to amplify signals in electronic systems such as, for example, scanning electron microscopes, mass spectrometers, field ion microscopes, and night vision devices.

The night vision field is by far the leading commercial field for units using MCPs. It therefore tends to drive research and development of MCPs and systems benefitting from-MCPs. In this connection there has developed a demand for night vision units of enhanced capabilities and this invention will be described with reference to a wafer tube image intensifier. However, as will be apparent to those skilled in the art, the innovations described herein will be applicable in systems with like structures other than night vision tubes. It should therefore be understood that it is not intended to limit this invention to the field of night vision or wafer tubes notwithstanding the emphasis herein on such units.

BACKGROUND OF THE INVENTION

Wafer tubes typically comprise an image input window bonded to a photocathode, an MCP, to provide electron amplification, and, an imaging phosphor screen. These components are mounted in a vacuum envelope and electrically biased. The MCP is formed with input and output electrodes, which are conductive coatings on the input and output surfaces of the MCP. Traditionally, standard type MCPs do not receive further processing after deposition of electrodes on the input and output surfaces. Typically the electrodes are nichrome or inconel coatings in the case of standard units, and for feedback limited MCPs (FLMCPs) a thick coating of, for example, aluminum, is deposited on the output end of the MCP as more fully described in copending application Ser. No. 07/724,041 entitled Feedback Limited Microchannel Plate Apparatus and Method and filed in the names of Aebi and Costello, now U.S. Pat. No. 5,268,612 which issued on Dec. 7, 1993.

In general, in the manufacture of standard type night vision tubes, almost all meet specifications and do not include defects due to emission points on the output end of the MCP which disrupt and distort the output image. This type of distortion will be found only in about 4% of the typical manufacturing run. However, this problem is significant in the manufacture of enhanced tubes. Here losses as high as 50%, depending on the specification for the tubes being fabricated, may be typical. An enhanced tube, for example, may comprise a wafer tube in which the positioning of the MCP is closer to the output phosphor than would be the case for a standard tube or a FLMCP.

SUMMARY OF THE INVENTION

This invention is directed toward providing significant yield improvements in the manufacture of proximity-focused image intensifier tubes and other enhanced tubes and systems. Such tubes are subject to yield loss due to spurious electron emission from the MCP output to the output phosphor screen. These emissions can prevent tubes from meeting specifications and cause .defects and or distortions in the output image and thus, this invention is particularly applicable to such units. These include tubes made with short MCP to screen spacing; those using high MCP to screen bias voltage; and, those using FLMCPs. The benefits of this invention may be achieved by applying a thin (approximately 700 to approximately 1000 angstrom) film of a binding material over the output end of an MCP directly on the output side metallization.

Under certain conditions, the output electrodes of traditional MCPs and FLMCPs emit electrons not related to the input signal to the MCP. These spurious emissions increase the noise in the MCP output and therefore decrease the value of the output signal to noise ratio and increase the noise factor. The spurious electron emissions are most likely to occur when the electric field between the MCP output and the collection anode is high, such as when the device is run at a high output bias voltage or when the collection anode is placed close to the MCP output end which increases the field and is intended to increase resolution.

An object of this invention is to provide a microchannel plate apparatus and method that limits these spurious electron emissions. In accordance with one aspect of this invention, therefore, the MCP output metallization layer or electrode is covered with a thin coating to reduce the number of spurious electron emissions hitting the phosphor screen or other collection anode.

DESCRIPTION OF THE INVENTION

Figure 1:
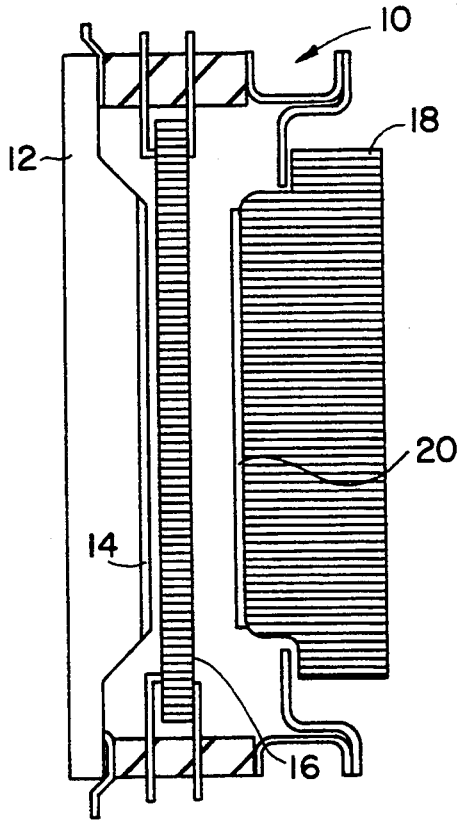
FIG. 1 PRIOR ART
FIG. 1 is a schematic, elevational, sectional view of a prior art wafer tube image intensifier.

As shown in FIG. 1, a proximity-focussed wafer tube image intensifier 10 includes an input window 12 of glass or a fiber optic face plate with a photocathode 14 bonded thereto. The microchannel plate 16 is spaced from and mounted parallel with the photocathode 14. Downstream of MCP 16 a phosphor screen 20 is provided on an output window 18 in the form of another glass or fiber optic faceplate. The input window 12 and output window 18 are mounted on opposite ends of a vacuum housing with the microchannel plate 16 contained there between within the vacuum housing. The tube is provided with electrical leads for applying appropriate desired voltages to the photocathode 14, an input electrode 24 (see FIG. 2) on the front (input) and an output electrode 26 (see FIG. 2) on the back (output) of MCP 16 and phosphor screen 20.

The three main components of a wafer tube 10 are the photocathode 14, the microchannel plate 16, and the output phosphor screen 20. The input signal to the wafer tube is light that strikes the photocathode 14. The photocathode 14 converts the incoming light into photoelectrons which enter the microchannel plate at the input side. MCP 16 serves as a high resolution electron multiplier which amplifies the photoelectron image. As used in an image intensifier, the MCP typically has an electron gain of 100–5000. The amplified signal is accelerated by a 6 kV bias between the MCP output and an aluminum collection anode on the phosphor screen 20, and the phosphor screen converts the electron energy into output light allowing the image to be viewed.

Figure 2:
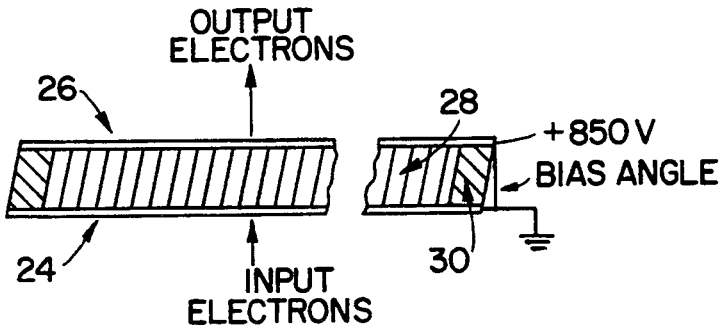
FIG. 2 PRIOR ART
FIG. 2 is an enlarged, foreshortened view of a prior art microchannel plate.
Figure 3:
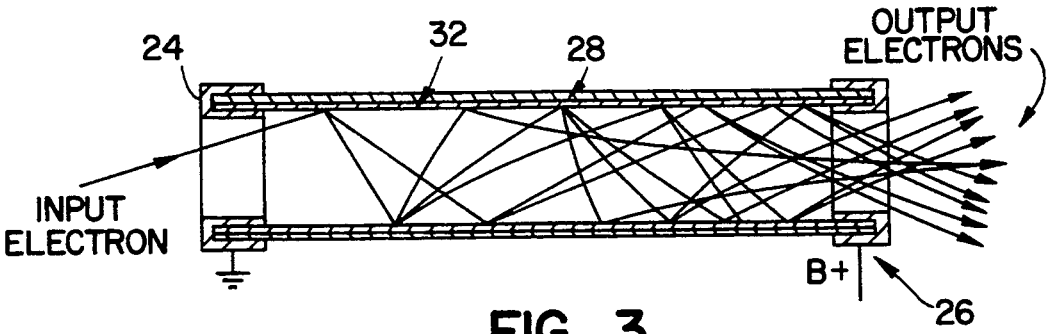
FIG. 3 PRIOR ART
FIG. 3 is an enlarged schematic view of a single channel multiplier taken from a microchannel plate of the prior art.

MCP 16 as shown enlarged in FIG. 2 comprises an array of miniature channel multipliers 28 of hollow glass fibers fused together and surrounded by a solid glass border ring 30. As shown in FIG. 3 each channel multiplier 28 detects and amplifies incident radiation and particles such as electrons or ions. The channel multiplier concept is based on the continuous dynode electron multiplier suggested by P. T. Farnsworth, U.S. Pat. No. 1,969,399. The channel multiplier 28 consists of a hollow tube coated on the interior surface by a secondary electron emitting semiconductor layer 32. This layer 32 emits secondary electrons in response to bombardment by electromagnetic radiation or particles such as electrons. The input and output metal electrodes 24 and 26 are provided on each end of the tube 28 and a bias voltage is applied across the channel. This bias voltage creates an axial electric field which accelerates the emitted secondary electrons down channel 28. The secondary electrons strike the wall again releasing additional secondary electrons. This process repeats as the electrons are accelerated down the channel. This results in amplification of the input photon or particle. A large pulse of electrons is emitted from the output end of channel 28 in response to the input photon or particle.

In the MCP shown in FIGS. 1–3, the input and output electrodes 24 and 26 are formed on each surface of the plate by deposition of a thin metallization layer. The layer thickness is typically on the order of about 800Å for the input electrode 24 and about 1100Å for the output electrode 26. Nichrome or inconel are the commonly used electrode materials. These materials are used because of their good adhesion to the glass surface of the MCP.

Figure 4:
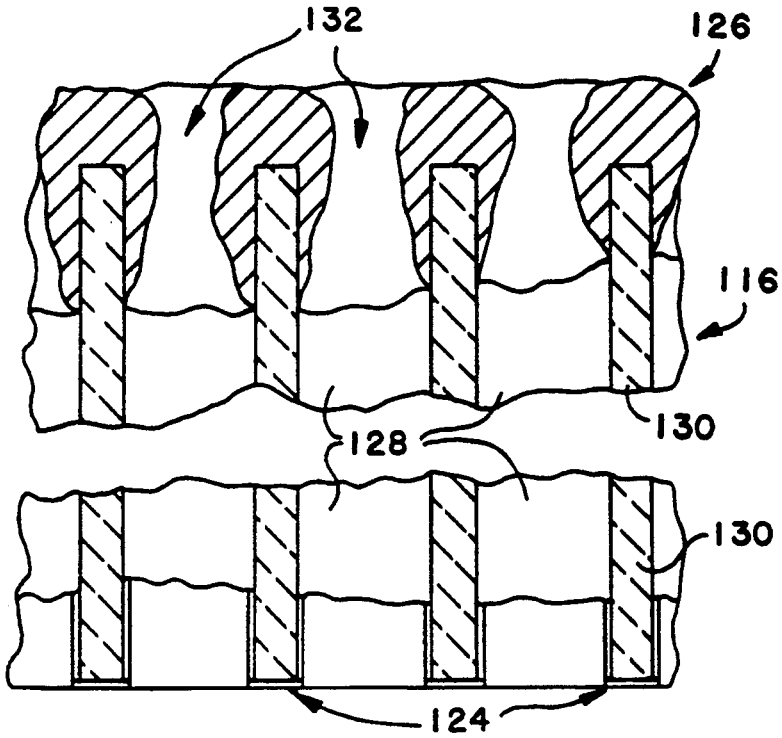
FIG. 4 is an enlarged foreshortened view of a feedback-limited microchannel plate.

An alternative MCP for use in image intensifiers and other applications is the FLMCP. As shown in FIG. 4, the feedback-limited MCP 116 replaces the thin nichrome or inconel output electrode with a thicker aluminum output electrode 126 to substantially reduce the open area of the channels 128 formed by the MCP channel walls 130. Application of the thicker electrode reduces the open area of the MCP output between 10% and 85%, which effectively reduces the feedback effects from the device output screen to the MCP output electrode.

One measure of the effectiveness of an MCP device is its noise factor. For example, the noise performance of an image intensifier is critical to its usefulness as a low light level imager. The noise performance is typically characterized by the noise factor, $K_f$, of the image intensifier, as defined by the following equation:

$$K_f = \frac{SNR_{in}}{SNR_{out}}$$

where SNR is the signal-to-noise power ratio. $SNR_{in}$ is the SNR of the input electron flux to the MCP. In an image intensifier this is also the SNR of the photoelectron flux from the photocathode. $SNR_{out}$ is the SNR of the output photon flux from the image intensifier phosphor screen. Both ratios are measured over the same noise bandwidth.

The effect of an electric field on a potential electron emitter depends in part on the emitter's geometry. For a given material, a sharp point will emit electrons at a lower electric field strength than a smooth surface. For a given surface geometry, metals will emit electrons at a lower electric field strength than dielectrics. This invention therefore addresses both the material and the geometry of the surface of an MCP output electrode.

The surface of MCP output electrodes, particularly FLMCP aluminum output electrodes, may be rough or uneven. The uneven surface geometry is due in part to the methods by which the electrodes are deposited on the MCP, in part to the inherent granularity of the metal and/or impurities in the metal, and in part to flaking or rippling of the electrode surface under the influence of the electric field. Raised spots on the surface of the metal electrodes are likely to be the source of spurious electron emissions from the MCP to the device's collection anode.

According to the preferred embodiment of this invention, a thin coating is applied to the output electrode In order to maintain the mechanical integrity and smoothness of the surface of the electrode by preventing the electric field from raising metal pieces from the surface of the electrode. The coating is thought to bind the layer below. The coating may be either dielectric or metal. If the coating is a dielectric material, the thickness must be kept to a minimum to avoid a charge build-up across the coating which would adversely affect device resolution.

Figure 5:
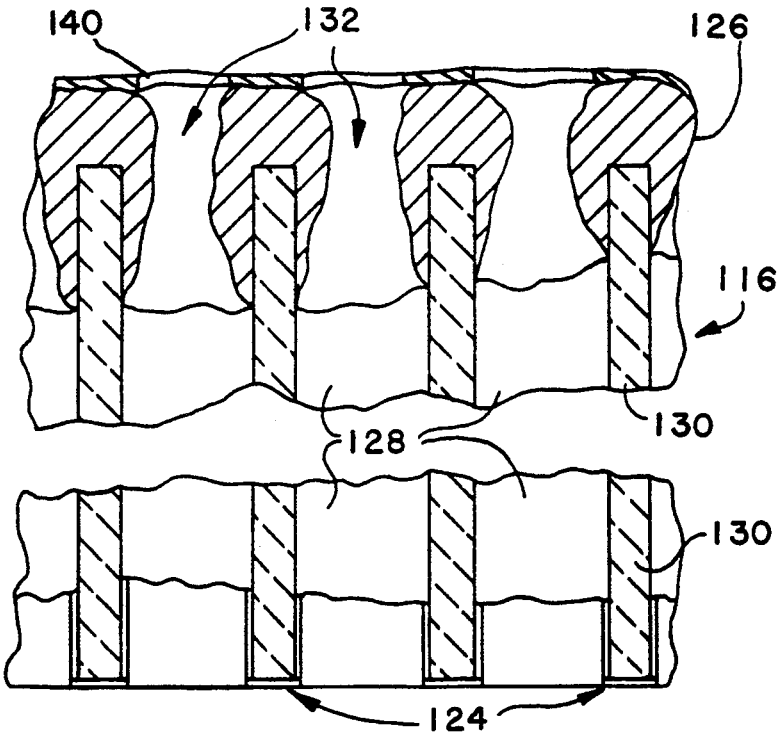
FIG. 5 is an enlarged foreshortened view of a feedback-limited microchannel plate with a coated output electrode according to a preferred embodiment of this invention.

An example of the preferred embodiment of this invention is shown in FIG. 5. The aluminum output electrode 126 of a FLMCP 116 was coated with a layer of silicon dioxide 140 using plasma-enhanced CVD. Other deposition techniques known in the art may also be used. The thickness of coating 140 was between about 700Å and about 1000Å. The use of coating 140 dramatically improved the performance of the MCP in a high resolution image intensifier by reducing the spurious electron emissions from the output electrode and thereby reducing the value of the noise factor $K_f$.

Other coating materials and other coating thicknesses may be used without departing from the scope of this invention. For example, silicon oxynitrides having the general formula $Si_xO_yN_z$, aluminum oxide, or amorphous silicon may be applied to the output electrode. The material should be one that adheres and conforms to the electrode. While dielectrics are preferred coating materials because of their low electron emissivity characteristics, a non dielectric coating on electrode 126 will also serve to provide and maintain the integrity of the surface. The thickness of coating 140 should be kept at a minimum in order to maintain the optimum size of openings 132 and to prevent capacitive charging of coating 140. It should also be noted that while the output electrode coating has a particular advantage when used with the FLMCP, the performance of prior art MCPs are enhanced by adding an output electrode coating in the same manner.

Although this invention has been described in terms of MCPs used in various forms of night vision tubes, it should be readily understood that the invention may be applied to advantage in other applications for MCPs and it is therefore intended to encompass such other applications by the claims appended hereto. It should also be understood that various alternatives to the embodiment shown here may be employed in practicing the present invention. It is therefore intended that the following claims be interpreted to broadly cover the invention, its disclosed structure and methods of practice and equivalents thereof.

We claim:

1. In a microchannel plate comprising a multiplicity of channels to multiply the electron output of electrons entering therein, an output electrode at the output end of said microchannel plate, the improvement comprising a dielectric binding coating having a thickness of approximately 700 to approximately 1000 angstroms on said output electrode to reduce spurious discharges therefrom in a vacuum environment.

2. The microchannel plate of claim 1 wherein the coating comprises silicon dioxide.

3. The microchannel plate of claim 1 wherein said output electrode comprises a deposit of aluminum.

4. A wafer night vision image intensifier tube comprising a vacuum enclosure including an input window, a photocathode bonded to said input window, a microchannel plate positioned in a substantially parallel relationship to said photocathode having two conductive electrodes, one on the input side and the other on the output side, an output phosphor layer bonded to an output window in a parallel relationship to the output end of said microchannel plate, and an output window, said microchannel plate including a thin binding coating having a thickness of approximately 700 to approximately 1000 angstroms on the output electrode to prevent granular pieces of the output electrode from being raised in an electric field extending between said output electrode of said microchannel plate and said output phosphor layer of said wafer night vision image intensifier tube.

5. A wafer tube in accordance with claim 4 wherein the coating on the output electrode comprises silicon dioxide.

6. A wafer tube in accordance with claim 4 in which said binding dielectric coating is silicon oxynitride.

7. A wafer tube in accordance with claim 4 wherein the coating on the output electrode comprises aluminum oxide.

8. A wafer tube in accordance with claim 4 wherein the coating on the output electrode comprises amorphous silicon.

9. A wafer tube in accordance with claim 4 wherein the conductive electrode on the output side of the microchannel plate comprises aluminum.

10. A wafer tube in accordance with claim 9 in which said conductive electrode on said output side of said microchannel plate is relatively thick and more than about 2.8 microns in thickness.

11. The method of improving yield in the manufacture of night vision devices employing output phosphor layers for the display of images comprising employing selected microchannel plates having an input electrode on the input end and an output electrode on the output end and including a thin dielectric binding coating of approximately 700 to approximately 1000 angstroms of a deposited binding material on said output electrode in the manufacture of night vision devices preventing grains of the materials of said output electrode from being raised in an electric field extending between said output electrode of said microchannel plate and said output phosphor layer of said night vision device during operation of such a night vision device.

12. In a microchannel plate comprising a multiplicity of channels to multiply the electron output of electrons entering therein, an output electrode at the output end of said microchannel plate, the improvement comprising a binding coating of a material with low emission characteristics which is selected from the group consisting of dielectrics and metals disposed on said output electrode to reduce spurious discharges therefrom unrelated to input electrons flowing to said microchannel plate in a vacuum environment.

13. In a microchannel plate as set forth in claim 12, said binding coating of material comprising a thin metallic layer having a thickness of approximately 700 to approximately 1000 angstroms disposed on said output electrode.

* * * * *